US006600484B1

(12) United States Patent
Miyagawa

(10) Patent No.: US 6,600,484 B1
(45) Date of Patent: Jul. 29, 2003

(54) LIQUID CRYSTAL DISPLAY AND METHOD FOR CONTROLLING LIQUID CRYSTAL DISPLAY WITH DECREASED POWER CONSUMPTION AND WITHOUT REDUCTION IN DISPLAY QUALITY

(75) Inventor: Hiroki Miyagawa, Niigata (JP)

(73) Assignee: NEC Corporation, Tokyo (JP)

( * ) Notice: Subject to any disclaimer, the term of this patent is extended or adjusted under 35 U.S.C. 154(b) by 279 days.

(21) Appl. No.: 09/691,047

(22) Filed: Oct. 19, 2000

(30) Foreign Application Priority Data

Oct. 21, 1999 (JP) ..... 11-299390

(51) Int. Cl.[7] ..... G09G 5/00
(52) U.S. Cl. ..... 345/212; 345/213; 345/99
(58) Field of Search ..... 345/204–205, 345/206, 690–697, 208–215, 87–103

(56) References Cited

U.S. PATENT DOCUMENTS 4,746,915 A * 5/1988 Sekiya ..... 345/205
5,644,331 A * 7/1997 Hazama ..... 345/99
6,169,532 B1 * 1/2001 Sumi et al. ..... 345/98
6,177,919 B1 * 1/2001 Numao ..... 345/94
6,191,779 B1 * 2/2001 Taguchi et al. ..... 345/204
6,392,354 B1 * 5/2002 Matsueda ..... 315/169.1
6,424,328 B1 * 7/2002 Ino et al. ..... 345/87

FOREIGN PATENT DOCUMENTS

JP 10-312175 11/1998

* cited by examiner

*Primary Examiner*—Steven Saras
*Assistant Examiner*—Amr Awad
(74) *Attorney, Agent, or Firm*—Sughrue Mion, PLLC

(57) ABSTRACT

A liquid crystal display provided with a liquid crystal display unit with pixels disposed on a board in a shape of matrix, a driver for supplying a signal to the respective pixels based on the display data so to display an image, and a control unit for controlling the driver, comprises switches provided in each signal line for supplying a signal from the driver to the respective pixels, and a liquid crystal display state judging unit for judging the display state on the liquid crystal display unit, thereby to on-off control the switches based on the result judged by the liquid crystal display state judging unit.

12 Claims, 5 Drawing Sheets

LIQUID CRYSTAL DISPLAY AND METHOD FOR CONTROLLING LIQUID CRYSTAL DISPLAY WITH DECREASED POWER CONSUMPTION AND WITHOUT REDUCTION IN DISPLAY QUALITY

BACKGROUNDS OF THE INVENTION

1. Field of the Invention

The present invention relates to a liquid crystal display, and more particularly to a liquid crystal display and its display-controlling method capable of decreasing the electric power consumption without damaging the display quality of a liquid crystal display unit.

2. Description of the Related Art

A liquid crystal display, of matrix type has been widely used as a display of a personal computer and the like, because it is thin and light and its electric power consumption is small. Recently, the liquid crystal display of matrix type, especially having low electric power consumption is positively developed because of environmental problem and the other needs.

FIG. 5 is a view showing the structure of a liquid crystal display disclosed in Japanese Patent Publication (Kokai) No. Heisei 10-312175. As illustrated in FIG. 5, this display comprises a matrix board 101, a plurality of pixel electrodes 102 provided on this matrix board in a shape of matrix, signal lines 103 interposed between these pixel electrodes, gate lines 104 interposed between the pixel electrodes in a direction different from that of the signal lines, switching elements 105 disposed between the pixel electrodes and the signal lines and on/off controlled by the gate lines, a driving circuit 106 for driving the signal lines based on input data, and a controller 107 for controlling the driving circuit 106.

This liquid crystal display is further provided with switching means 108 in every (n) signal lines, which are the lines for supplying the input data to the signal lines 103, so as to decrease the number of data to be sent from the driving circuit 106 to the display matrix board 101, for decreasing the electric power consumption, by the on/off operation of this switching means 108.

This conventional liquid crystal display, however, is provided with one switching means 108 per n signal lines 103, and therefore, one for n signal lines, namely, at least one for two is always switched off, regardless of the state of an image. Therefore, although the electric power consumption is surely decreased, the quality of images may be deteriorated depending on a display state of the images. Especially, in the case of displaying a moving picture, since the display screen is frequently changed, it is necessary to keep the high quality of the images. The conventional display as shown in FIG. 5, however, may not satisfy the needs.

SUMMARY OF THE INVENTION

In order to solve the problem, an object of the present invention is to provide a liquid crystal display and its display-controlling method capable of keeping the quality of images required according to the display state on a screen and capable of decreasing the electric power consumption.

According to one aspect of the invention, a liquid crystal display provided with a liquid crystal display unit with pixels disposed on a board in a shape of matrix, driver means for supplying a signal to the respective pixels based on display data so to display an image, and control means for controlling the driver means, the display comprises switching means provided in every signal line for supplying a signal from the driver means to the respective pixels, and liquid crystal display state judging means for judging display state on the liquid crystal display, the switching means being on-off controlled based on the result judged by the liquid crystal display state judging means.

The liquid crystal display of the present invention is provided with switching means in the respective signal lines for supplying signals from the driver means to the respective pixels, and display judging means for judging the display state on a liquid crystal display unit. Therefore, after the display judging means judges the display state on the liquid crystal display unit, the number of signal lines for supplying the display data can be selected according to the judgment result. Namely, since it is possible to adjust the number of signal lines to be switched off, depending on the necessity, this liquid crystal display can decrease the electric power consumption, in accordance with a change of the data to be displayed on the liquid crystal display unit, without deteriorating the display quality.

In the preferred construction, the liquid crystal display further comprises memory means of storing switching timing data for on-off controlling the switching means as for the display state on the liquid crystal display unit.

Thus, the liquid crystal display of the present invention is provided with memory means, where switching timings suitable to various display states are stored, and it can select the switching timing suitable to the display state judged by the display state judging means so to switch the signal lines according to the same timing. As a result, the signal lines can be thinned out at the timing suitable to the display state.

In another preferred construction, the liquid crystal display unit is driven by active matrix drive system.

In the liquid crystal display of the present invention, when the liquid crystal display unit is formed in an active matrix type, a pixel may be formed by a TFT (Thin Film Transistor). Forming a pixel by a thin film transistor can realize a superior liquid crystal display in contrast, display of gradation, and response speed.

In another preferred construction, TFTs (Thin Film Transistors) are provided as for the respective pixels.

In another preferred construction, the liquid crystal display unit is driven by simple matrix drive system.

In another preferred construction, second memory means for temporarily storing display data information to be displayed on the liquid crystal display unit is provided in the driver means, and the liquid crystal display judging means judges the display state on the liquid crystal display unit, according to a change of the display data in the second memory means.

According to the liquid crystal display of the present invention, a change in the ratio of the number of display pixels to the number of the whole pixels, corresponding to a time change of the display data information, is calculated, so to judge the display state on the liquid crystal display unit. For example, when a change in the ratio of the number of the display pixels to the number of the whole pixels is high, the display state on the liquid crystal display unit can be judged to vary frequently, and when it is low, the display state can be judged to be stable.

In another preferred construction, the liquid crystal display further comprises memory means of storing switching timing data for on-off controlling the switching means as for the display state on the liquid crystal display unit, second memory means for temporarily storing display data information to be displayed on the liquid crystal display unit, which is provided in the driver means, the liquid crystal display judging means judging the display state on the liquid crystal display unit, according to a change of the display data in the second memory means.

According to another aspect of the invention, a display controlling method of a liquid crystal display provided with a liquid crystal display unit with pixels disposed on a board in a shape of matrix, driver means for supplying a signal to the respective pixels based on display data so to display an image, and control means for controlling the driver means, the method comprising the following steps of judging display state on the liquid crystal display unit by the liquid crystal display, and on-off controlling the switching means provided in each signal line for supplying a signal from the driver means to the respective pixels based on the above judgment result.

In the preferred construction, the display controlling method of a liquid crystal display comprising the following steps of storing switching timing data for on-off controlling the switching means into the memory means, as for the display state on the liquid crystal display unit, and on-off controlling the switching means based on the switching timing data.

In another preferred construction, the-display controlling method of a liquid crystal display comprising the following steps of temporarily storing the display data information to be displayed on the liquid crystal display unit into the second memory means within the driver means, and judging the display state on the liquid crystal display unit, according to a change of the display data in the second memory means.

In another preferred construction, the display controlling method of a liquid crystal display comprising the following steps of storing switching timing data for on-off controlling the switching means into the memory means, as for the display state on the liquid crystal display unit, on-off controlling the switching means based on the switching timing data, temporarily storing the display data information to be displayed on the liquid crystal display unit into the second memory means within the driver means, and judging the display state on the liquid crystal display unit, according to a change of the display data in the second memory means.

According to a still further aspect of the invention, a liquid crystal display provided with a liquid crystal display unit with pixels disposed on a board in a shape of matrix, driver which supplies a signal to the respective pixels based on display data so to display an image, and controller which controls the driver, the display comprises switching unit provided in every signal line which supplies a signal from the driver to the respective pixels, and liquid crystal display state judging unit which judges display state on the liquid crystal display, said switching unit being on-off controlled based on the result judged by said liquid crystal display state judging unit.

Other objects, features and advantages of the present invention will become clear from the detailed description given herebelow.

BRIEF DESCRIPTION OF THE DRAWINGS

The present invention will be understood more fully from the detailed description given herebelow and from the accompanying drawings of the preferred embodiment of the invention, which, however, should not be taken to be limitative to the invention, but are for explanation and understanding only.

In the drawings.

DESCRIPTION OF THE PREFERRED EMBODIMENT

The preferred embodiment of the present invention will be discussed hereinafter in detail with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to unnecessary obscure the present invention.

Figure 1:
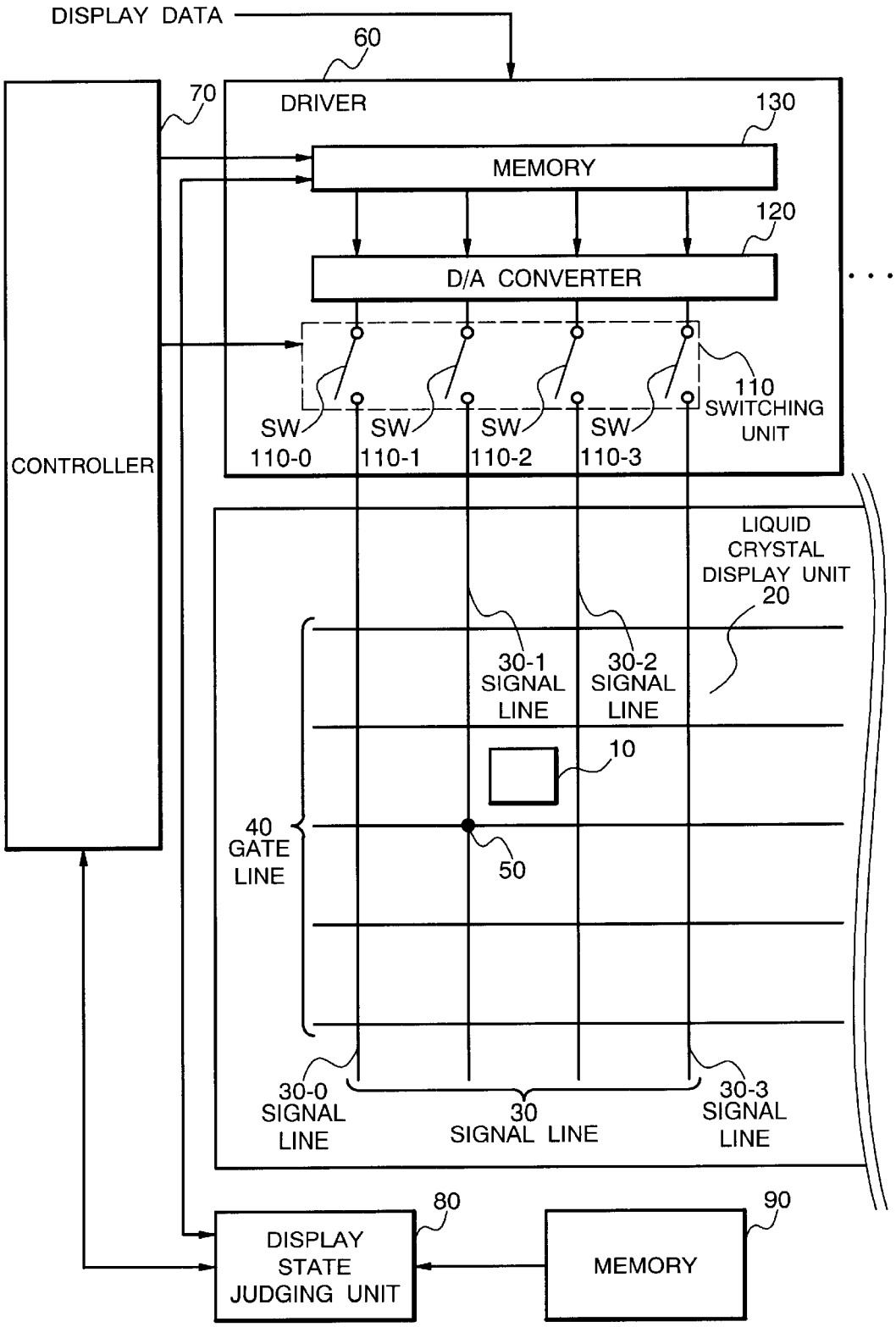
FIG. 1 is a block diagram showing the structure of a liquid crystal display according to a preferred embodiment of the present invention.

FIG. 1 is a block diagram showing the structure of a liquid crystal display of the present invention. As apparent from FIG. 1, the display of the present invention comprises a liquid crystal display unit 20 with pixels 10 arrayed in a shape of matrix, signal lines 30 interposed between these pixels, gate lines 40 interposed between the pixels in a direction different from that of the signal lines, TFT (Thin Film Transistor) switching elements 50 disposed between the display pixels and the signal lines and on-off controlled by the gate lines 40, a driver 60 for sending input data to the signal lines by an analog voltage signal, a controller 70 for controlling this driver 60, a display state judging unit 80 for judging the display state of the liquid crystal display unit 20, and a memory 90 storing switching timing data (timing table) suitable to each display state on the liquid crystal display unit 20.

The driver 60 includes a switching unit 110 for switching on and off each signal line 30, a D/A converting unit 120 for converting the display data into analog voltage signals, and a memory 130 for temporarily storing the display data supplied from the outward.

Although the present embodiment is described, by way of example, in the case of switching four signal lines 30-0 to 30-3 by four switches 110-0 to 110-3 of the switching unit 110, the number of the signal lines is not restricted to four used in this embodiment.

Figure 2:
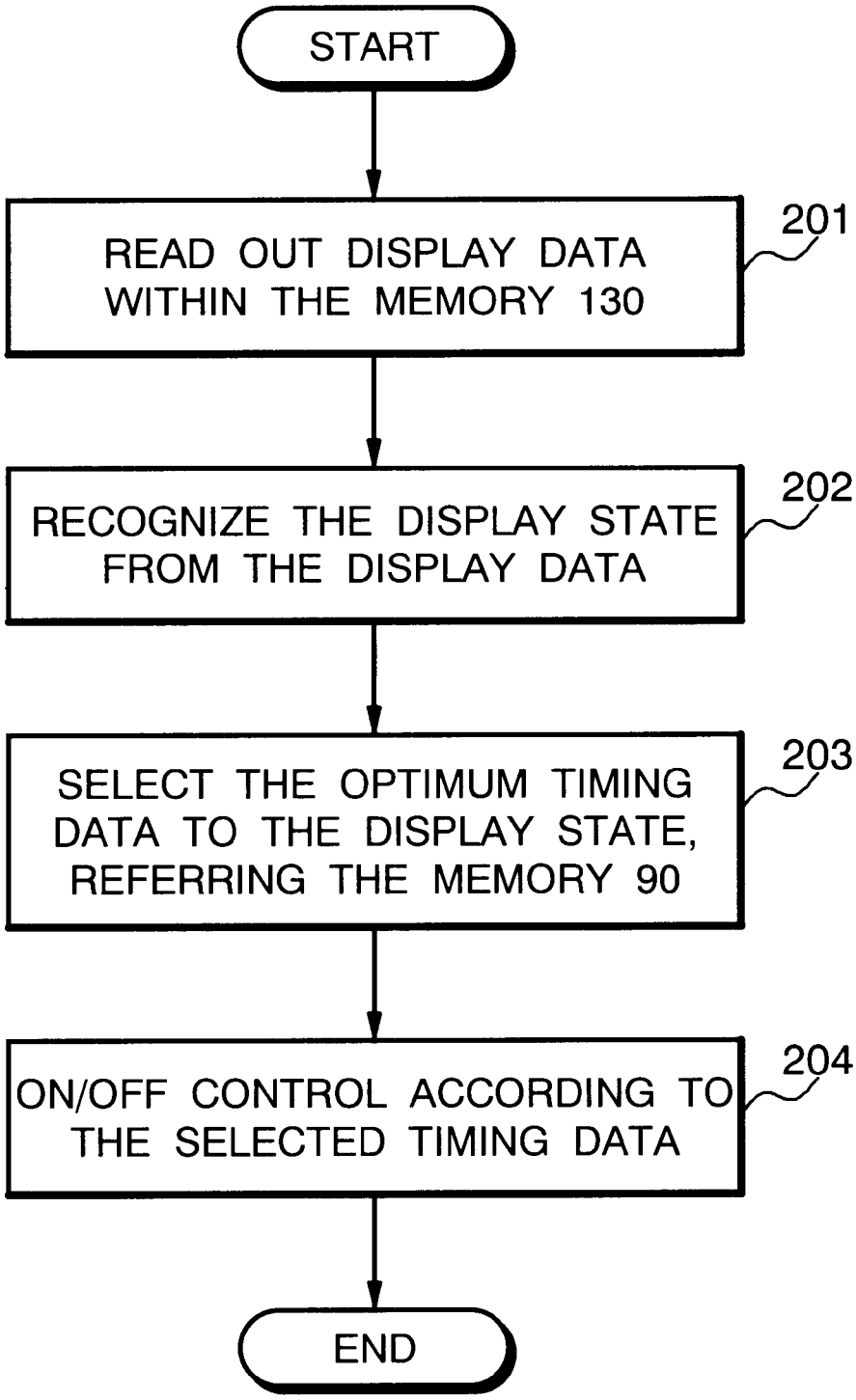
FIG. 2 is a flow chart for use in describing the content of the processing of a switching control in the display shown in FIG. 1.

The operation of the liquid crystal display of the present invention shown in FIG. 1 will be described. FIG. 2 is a flow chart for use in describing the processing operation of the controller 70 and the display state judging unit 80.

The display data to be displayed on the liquid crystal display unit 20 is supplied to the driver 60, and temporarily stored in the memory 130 within the driver 60. The data stored in the memory 130 is read out under a control of the controller 70, converted into analog voltage signals by the D/A converter 120, and transmitted to the liquid crystal display unit 20 through the signal lines 30.

At this time, the display state judging unit 80 reads out the data stored in the memory 130 within the driver 60 (Step 201 in FIG. 2), so to recognize the display state on the liquid crystal display unit 20 from the data (Step 202 in FIG. 2). The display state judging unit 80 selects the switching timing data suitable to the display state recognized by reference to the memory 90 and reads out the same (Step 203 in FIG. 2).

The controller 70 thins out the signal lines 30 depending on the necessity, so to send the analog voltage signal to the liquid crystal display unit 20, while performing the on-off control on the respective switches of the switching unit 110 according to the switching timing data read out by the display state judging unit 80 (Step 204 in FIG. 2).

In the display state judging unit 80, the recognition of the display state on the liquid crystal display unit 20 and the selection of the optimum switching timing data will be performed as follows.

Namely, the display state judging unit 80 reads out the display data of the memory 130 at the time t and the display data of the memory 130 at the time t+Δ, calculates the difference between the number of display pixels corresponding to the display data at the time t and the number of display pixels corresponding to the display data at the time t+Δ by the comparison therebetween, and further calculates the ratio of this difference to the whole pixels.

In the memory 90, a plural set of the ratio of the number of the changed pixels to the number of the whole pixels and the corresponding switching timing data suitable to every ratio is stored. The display state judging unit 80 selects the switching timing data suitable to the ratio of the changed pixel number calculated in the above (that is, the number of the pixels changed between the time t and the time t+Δ) to the whole pixel number, from the memory 90, and supplies this to the controller 70.

The controller 70 can thin out the signal lines 30 suitably to the display state on the liquid crystal display unit 20, by performing the on-off control on the switches 110 according to this timing data.

The timing data stored in the memory 90 is the timing of switching on and off the respective switches 110-0 to 110-3 of the switching unit 110 within the driver 60, and it means the data about how to switch on and off which switch in every timing clock.

Figure 3:
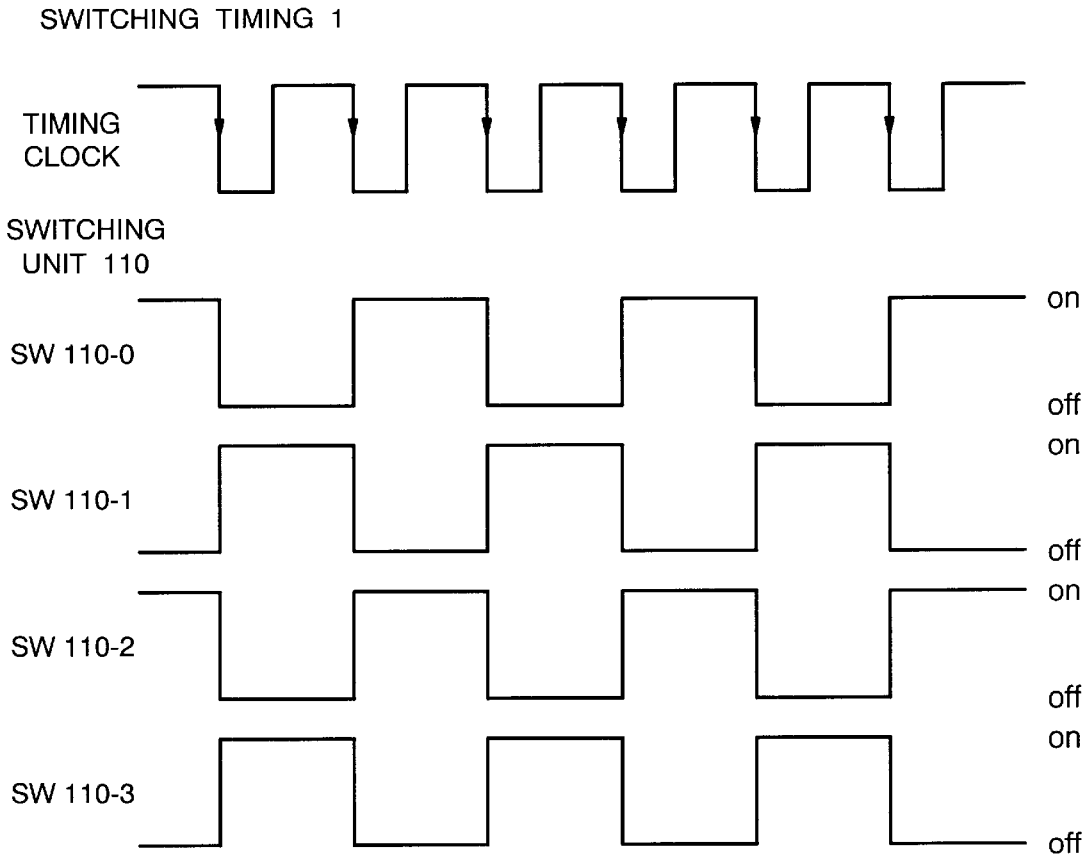
FIG. 3 is a timing chart showing one example of a switching timing in the display shown in FIG. 1.
Figure 4:
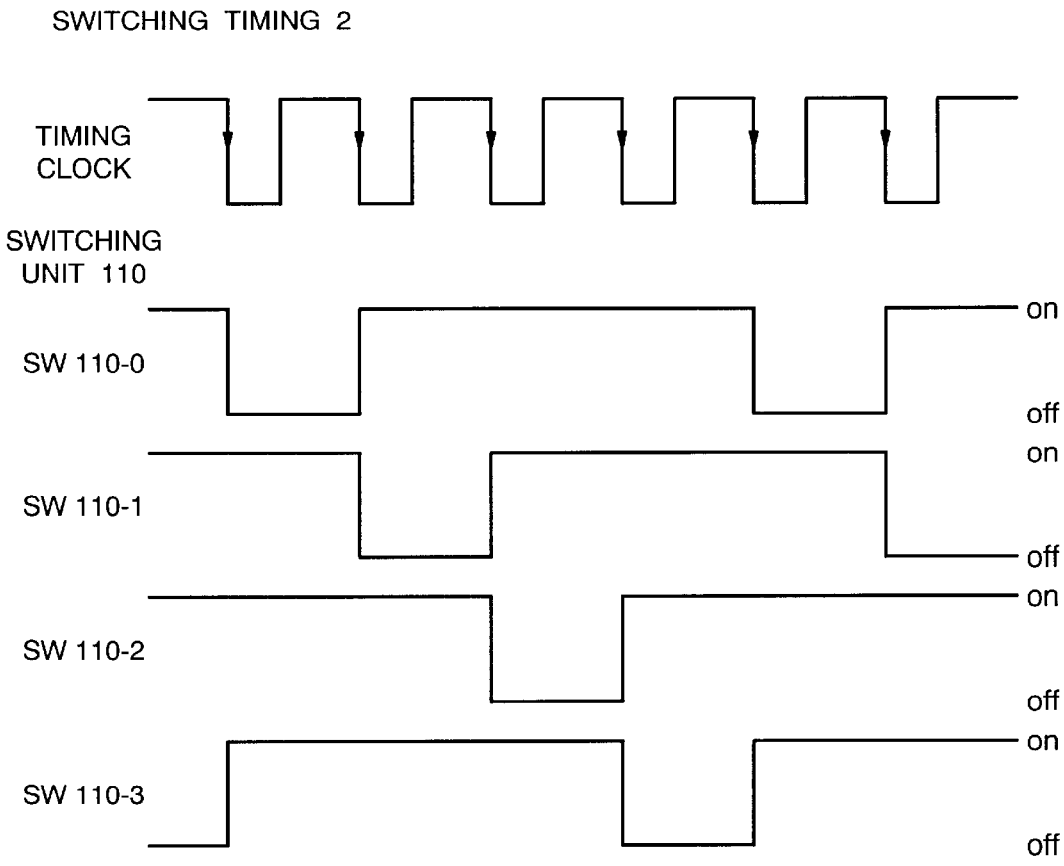
FIG. 4 is a timing chart showing another example of a switching timing in the display shown in FIG. 1.
Figure 5:
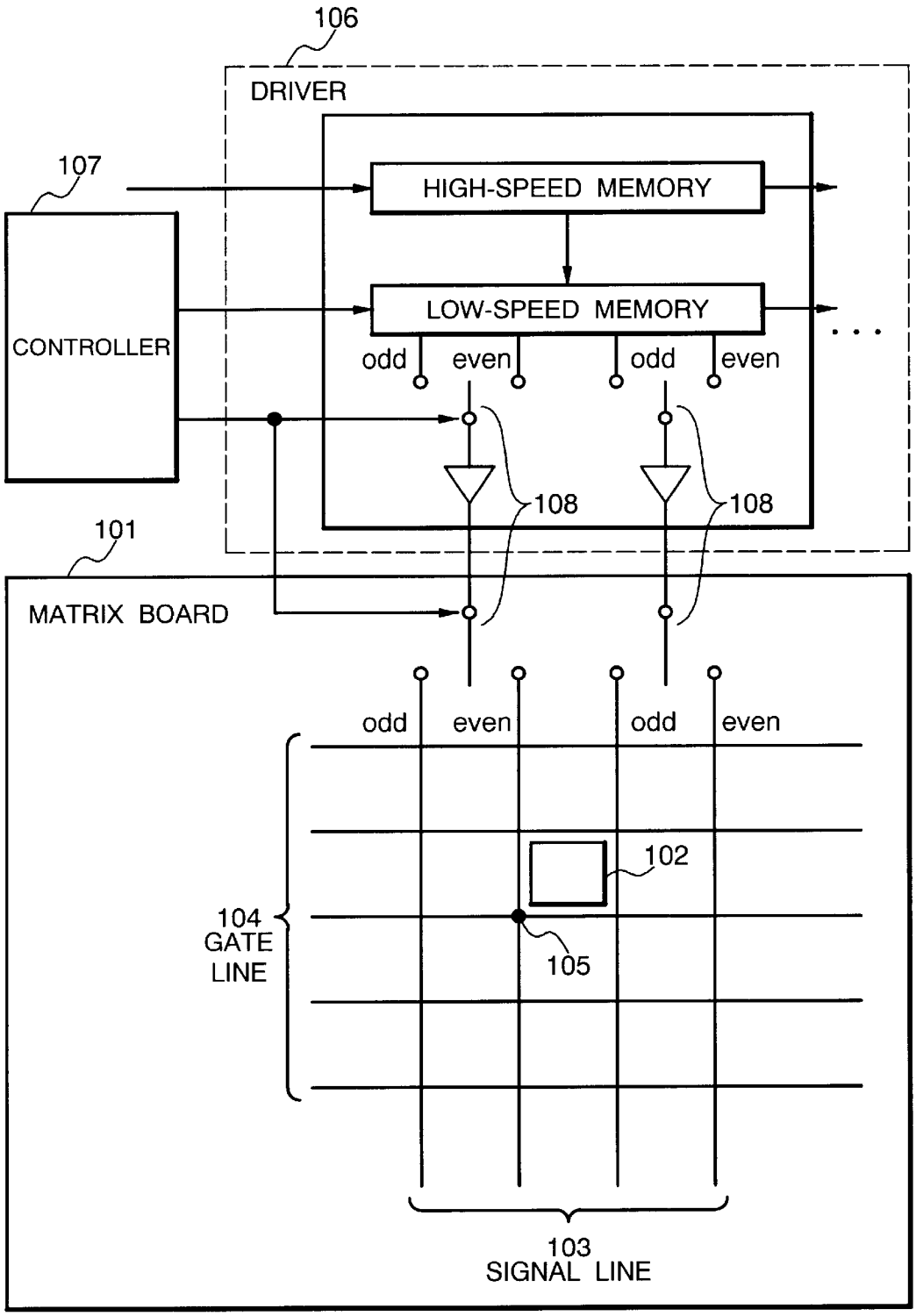
FIG. 5 (PRIOR ART)
FIG. 5 is a block diagram showing the structure of the conventional crystal liquid display.

FIG. 3 and FIG. 4 are timing charts showing an example of the above switching timing.

The timing chart shown in FIG. 3 is selected in the case of displaying, for example, a static image on the liquid crystal display unit 20. Namely, the data is read out at the ON-OFF timing by turns in every one dot, thereby to give priority to decrease the electric power consumption. Since it is supposed that the ratio of the changed pixel number to the whole pixel number is low in the static image, the timing data corresponding to this case becomes the content like the above such as switching on and off by turns in every one dot.

In the case where a display screen frequently changes such as a moving picture, one OFF operation is inserted into every four dots as illustrated in FIG. 4, so to decrease the degree of thinning out the signal lines 30 to read the data, thereby restraining the deterioration in the display quality on the liquid crystal display unit. Since it is supposed that the ratio of the changed pixel number to the whole pixel number is high in the moving picture, the timing data corresponding to this case becomes the content like the above such as switching off one dot in every four dots switched on.

The other variations, in the switching timings of the switching unit 110, may be considered besides the example shown in FIG. 3 and FIG. 4. For example, when the changing speed of a moving picture is too fast for a user to find the deterioration, the degree of thinning out the signal lines 30 may be increased even in the case of a moving picture. Namely, the number of ON operations may be decreased more than in the timing shown in FIG. 3.

Although the above-mentioned embodiment has been described, by way of example, in the case of the liquid crystal display of an active matrix drive system, the present invention can be adapted to a liquid crystal display of a simple matrix system. Further, the type of liquid crystal is not restricted to TFT but STN (Super Twisted Nematic Liquid Crystal), DSTN (Dual Scan Super Twisted Nematic Liquid Crystal), MIM (Metal Insulator Metal Liquid Crystal), and the like can be used preferably.

As set forth hereinabove, the liquid crystal display according to the present invention can decrease the electric power consumption intentionally, by thinning out the liquid crystal display in every dot. Further, provided with a means for recognizing the display state of a liquid crystal screen to thin out dots according to the display state recognized by this means, the liquid crystal display of the present invention can decrease the electric power consumption without damaging the quality in the liquid crystal display.

Although the invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodies within a scope encompassed and equivalents thereof with respect to the feature set out in the appended claims.

What is claimed is:

1. A liquid crystal display provided with a liquid crystal display unit with pixels disposed on a board in a shape of matrix, driver means for supplying a signal to the respective pixels based on display data to display an image, and control means for controlling the driver means, the display comprising:

switching means provided in every signal line for supplying a signal from the driver means to the respective pixels; and liquid crystal display state judging means for judging display state on the liquid crystal display, said switching means being on-off controlled based on the result judged by said liquid crystal display state judging means, wherein second memory means for temporarily storing display data information to be displayed on the liquid crystal display unit is provided in the driver means, and said liquid crystal display judging means judges the display state on the liquid crystal display unit, according to a change of the display data in said second memory means.

2. A liquid crystal display as set forth in claim 1, further comprising:

memory means of storing switching timing data for on-off controlling said switching means as for the display state on the liquid crystal display unit.

3. A liquid crystal display as set forth in claim 1, wherein the liquid crystal display unit is driven by active matrix drive system.

4. A liquid crystal display as set forth in claim 3, wherein TFTs (Thin Film Transistors) are provided as for the respective pixels.

5. A liquid crystal display as set forth in claim 1, wherein the liquid crystal display unit is driven by simple matrix drive system.

6. A display controlling method of a liquid crystal display provided with a liquid crystal display unit with pixels disposed on a board in a shape of matrix, driver means for supplying a signal to the respective pixels based on display data o display an image, and control means for controlling the driver means, the method comprising:

temporarily storing the display data information to be displayed on the liquid crystal display unit into a second memory means within the driver means;

judging display state on the liquid crystal display unit, according to a change of the display data in said second memory means; and on-off controlling a switching means provided in each signal line for supplying a signal from the driver means to the respective pixels based on result of the judging.

7. A display controlling method of a liquid crystal display as set forth in claim 6, further comprising:

storing switching timing data for on-off controlling said switching means into a memory means, as for the display state on the liquid crystal display unit; and on-off controlling said switching means based on the switching timing data.

8. A liquid crystal display provided with a liquid crystal display unit with pixels disposed on a board in a shape of matrix, driver which supplies a signal to the respective pixels based on display data to display an image, and controller which controls the driver, the display comprising:

switching unit provided in every signal line which supplies a signal from the driver to the respective pixels; and liquid crystal display state judging unit which judges display state on the liquid crystal display, said switching unit being on-off controlled based on the result judged by said liquid crystal display state judging unit, wherein second memory which temporarily stores display data information to be displayed on the liquid crystal display unit is provided in the driver, and said liquid crystal display judging unit judges the display state on the liquid crystal display unit, according to a change of the display data in said second memory.

9. A liquid crystal display as set forth in claim 8, further comprising:

memory which stores switching timing data for on-off controlling said switching unit as for the display state on the liquid crystal display unit.

10. A liquid crystal display as set forth in claim 8, wherein the liquid crystal display unit is driven by active matrix drive system.

11. A liquid crystal display as set forth in claim 10, wherein

TFTs (Thin Film Transistors) are provided as for the respective pixels.

12. A liquid crystal display as set forth in claim 8, wherein the liquid crystal display unit is driven by simple matrix drive system.

* * * * *